US006651420B2

(12) United States Patent
Simmen

(10) Patent No.: US 6,651,420 B2
(45) Date of Patent: Nov. 25, 2003

(54) METHOD AND DEVICE FOR TREATING FILAMENT YARN WITH AIR

(75) Inventor: Christian Simmen, Wattwil (CH)

(73) Assignees: Heberlein Fibertechnology, Inc. (CH); Karl Mayer Testilmaschinenfabrik GmbH (DE)

( * ) Notice: Subject to any disclaimer, the term of this patent is extended or adjusted under 35 U.S.C. 154(b) by 121 days.

(21) Appl. No.: 09/996,566

(22) Filed: Nov. 30, 2001

(65) Prior Publication Data

US 2002/0073684 A1 Jun. 20, 2002

Related U.S. Application Data

(63) Continuation of application No. 09/355,639, filed as application No. PCT/CH98/00039 on Jan. 29, 1998.

(30) Foreign Application Priority Data

Feb. 3, 1997 (DE) ..... 197 03 924

(51) Int. Cl.[7] ..... D01H 4/02
(52) U.S. Cl. ..... 57/333
(58) Field of Search ..... 28/178, 240, 271, 28/273, 274, 281; 57/287, 289, 290, 332, 333, 350

(56) References Cited

U.S. PATENT DOCUMENTS

| | | | | |
|---|---|---|---|---|
| 2,985,995 A | * | 5/1961 | Bunting, Jr. et al. | 57/140 |
| 3,279,164 A | | 10/1966 | Breen et al. | |
| 3,702,055 A | | 11/1972 | Kosaka et al. | |
| 4,807,431 A | | 2/1989 | Braxmeier | |
| 4,858,288 A | | 8/1989 | Hodgin et al. | |
| 5,119,623 A | * | 6/1992 | Fetzer et al. | 57/333 |
| 5,332,368 A | * | 7/1994 | Macier et al. | 417/362 |
| 5,379,501 A | | 1/1995 | Goineau | |
| 5,518,814 A | * | 5/1996 | Bonigk | 428/365 |
| 5,724,802 A | * | 3/1998 | Foster | 57/290 |

FOREIGN PATENT DOCUMENTS

| | | |
|---|---|---|
| DE | 196 05 675 | 8/1997 |
| EP | 088254 | 4/1988 |
| FR | 2363648 | 3/1978 |
| JP | 08 296132 | 11/1996 |

OTHER PUBLICATIONS

Dr. Demir, *Chemical Fibers International*, Istanbul, vol. 46, Oct. 1996, pp. 361–363.

International Search Report from PCT/CH98/00039 (counterpart international application of U.S. Application No. 09/355,639) dated Jun. 29, 1998.

* cited by examiner

*Primary Examiner*—John J. Calvert
*Assistant Examiner*—Shaun R Hurley
(74) *Attorney, Agent, or Firm*—Finnegan, Henderson, Farabow, Garrett & Dunner, L.L.P.

(57) ABSTRACT

The new invention proposes that filament yarns, in particular partially stretched yarns known as POY yarns, be subjected to stretch texturing via an air treatment nozzle. The air treatment nozzles are designed in miniaturized form, have a continuous yarn duct in which there open a plurality of transverse bores for the supply of high pressure air in the range over 14 bar, preferably within specific working windows between 20 and 50 bar. With the new invention, it was possible for the first time to process POY yarn via simultaneous stretch texturing using an air twister. The invention allows an individual thread as well as a parallel bundle of threads to be treated and permits for the first time the construction of a false twist stretch texturing bundle device with simultaneous air treatment of 500 to 1000 and more threads.

15 Claims, 8 Drawing Sheets

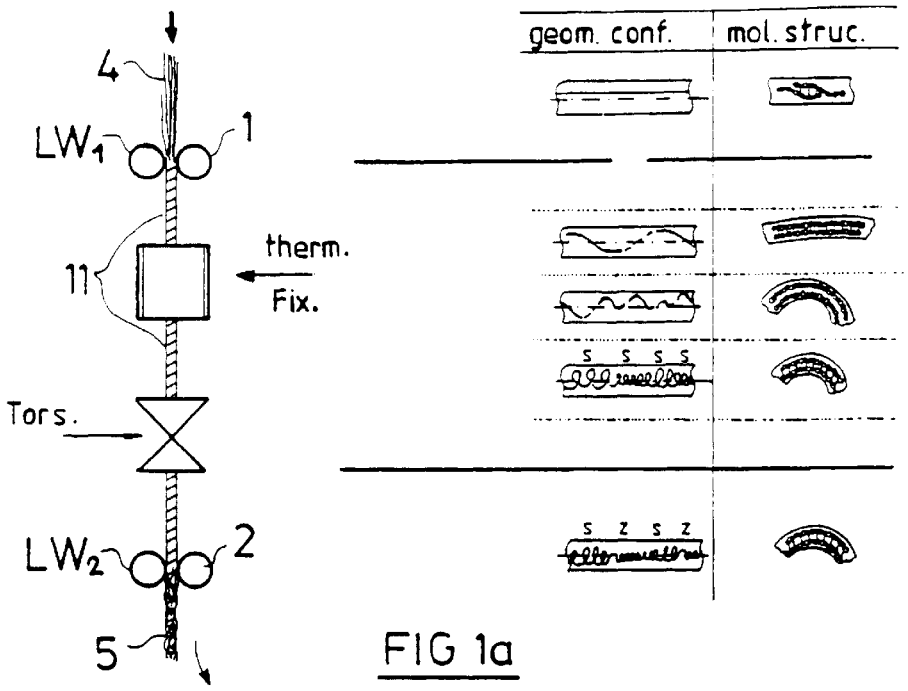
FIG 1a
FIG 1b
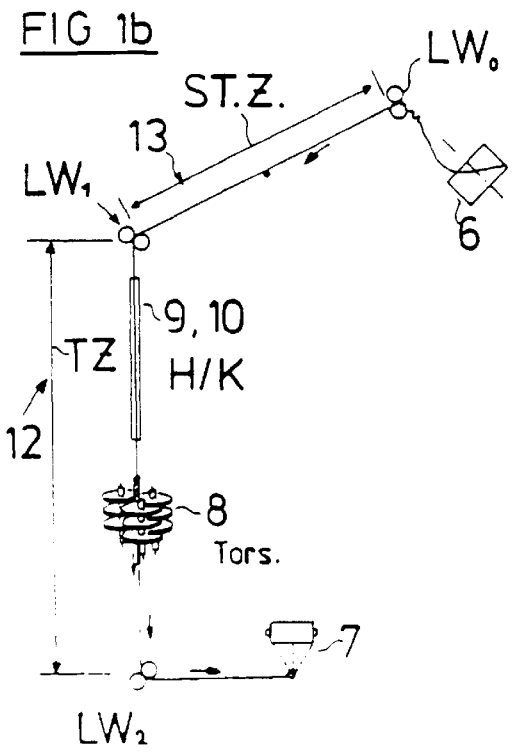
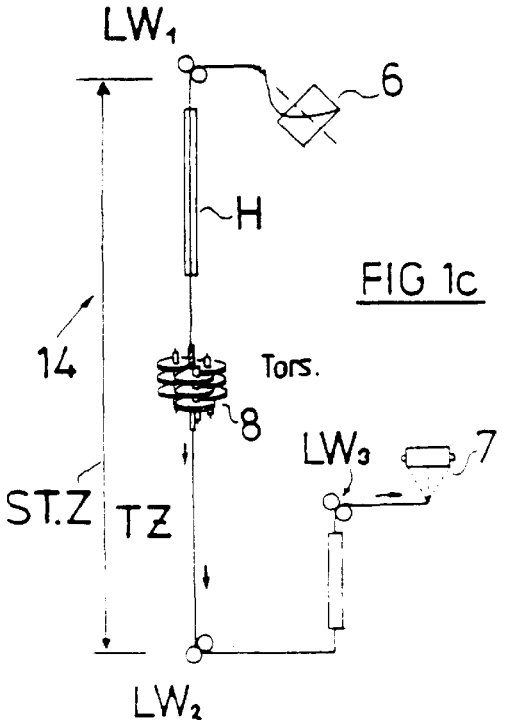
FIG 1c

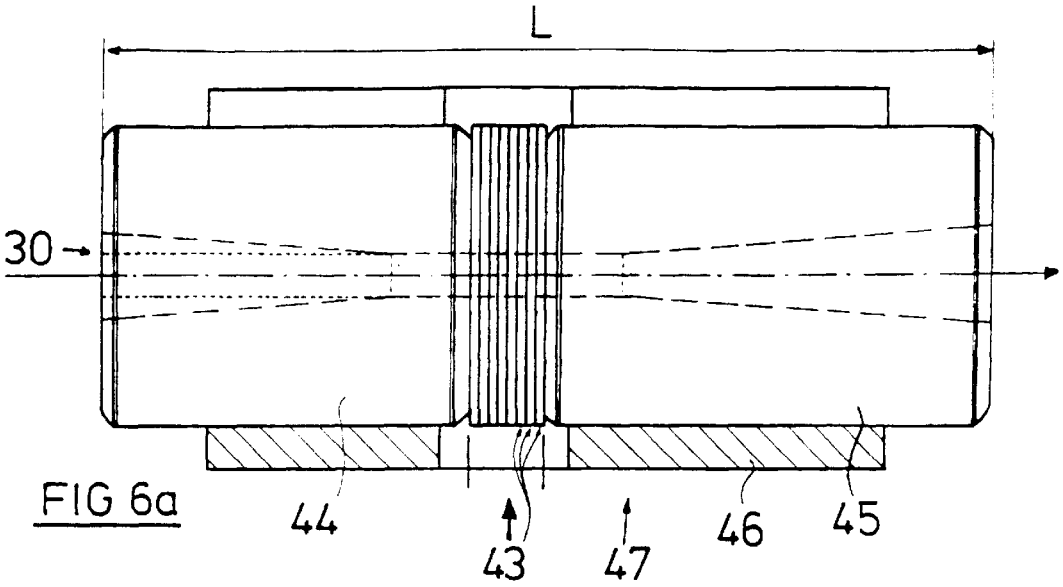
FIG 6a
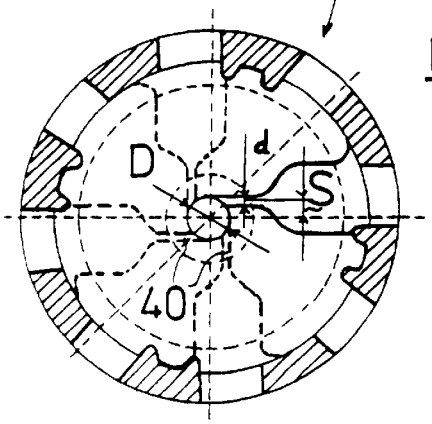
FIG 6b
FIG 6c
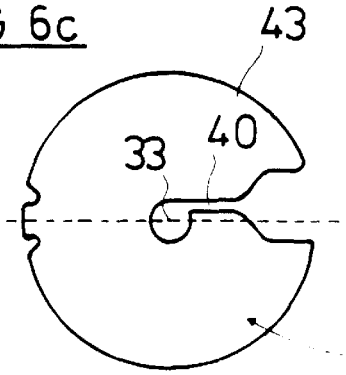
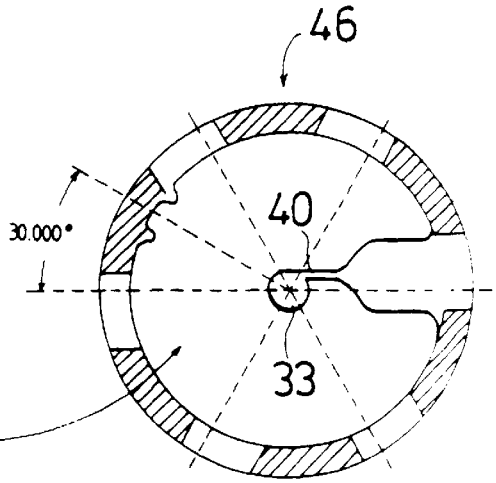
FIG 6d

METHOD AND DEVICE FOR TREATING FILAMENT YARN WITH AIR

This application is a continuation of U.S. application Ser. No. 09/355,639, filed Oct. 22, 1999, which is a 371 of PCT/CH98/00039, filed Jan. 29, 1998, both of which are hereby incorporated by reference.

TECHNICAL FIELD

The invention relates to a method and an apparatus for the air treatment of filament yarn with yarn treatment nozzles having a continuous miniaturized yarn duct into which compressed air or gaseous fluid is introduced and a dominant twisting flow is produced in the yarn duct.

STATE OF THE ART

The production of yarn from synthetic fibres involves quite a number of basic stages. The individual continuous filaments are extruded via spinnerets from hot liquid thermoplastic polymer raw material and are then solidified in a cooling stage. A desired number of filaments are then combined to form a single thread or yarn which is either cut into staple fibre or left as a continuous filament. The staple product will not be described in detail hereinafter. It is subjected to processing steps similar to those whose basic principle is known from conventional natural yarn production. The very fine filament produced under high pressure as well as the yarn produced therefrom has a number of basic properties. These prevent direct use of the solidified unstretched filaments for the production of textiles. A chain molecular during polymerization of a filament. If a yarn of this type is subjected to a more pronounced tensile stress, a considerable permanent change of length occurs. A typical representative of such a yarn which is designated POY (pre-oriented yarn) can be plastically stretched by a factor of 1:1.5 to 1.8.

30 years ago, it was normal to produce an LOY quality which even had to be stretched in a ratio of 1:3 to 3.8. The stretching process is a stage of operation which is essential for subsequent use for the production of textiles as the fabric (produced from unstretched yarn) would obviously be locally permanently elongated when first stressed. The second property is that the molecular orientation can be permanently changed at yarn temperatures of about 200° C. and higher if the yarn is cooled immediately after an appropriate operation. The reduction in temperature below the glass transition point sets the changed molecular orientation produced under the influence of force so to speak. The third property is based on the second. The yarn is subjected to pronounced twisting in the hot state and a pronounced twist applied to the yarn. This operation has been employed worldwide for many decades and is known as the false twist method. Friction spindles are normally used as twisters nowadays. A spiral molecular orientation is created in the yarn owing to the twist which is forced mechanically on the yarn, so the individual filament can pass into a curved form after solidification and in the relaxed state, as shown schematically on the right of FIG. 1 according to the state of the art. The main result of the helical molecular orientation produced in this way is that the relaxed yarn can take on bulkiness and a crimped structure. The resultant product is described as false-twist-textured yarn and imparts a textile character to the end product.

A further particular property of synthetic fibre yarns is that the individual filament is sometimes very thin. To achieve high productivity in an economic manner, many filaments are produced continuously from a corresponding number of spinnerets and at very high rates. The spinning rate was 1000 m/min in the 60s. This has increased continuously ever since and is now between 3000 and 8000 Two particular branches of processing, among others, have arisen for textured yarn production. In one case, texturing is linked directly with the spinning process; in the other case (for titres <1000, in particular <334), texturing has to be separated from the spinning process. There is an excessively large discrepancy between spinning rate (POY yarn 3–4000 m/min) and the possible texturing rate in the second case. Supply bobbins therefore have to be produced after spinning. Final stretching and texturing is then carried out with the supply bobbins, separately from the filament spinning process in position and time. With coarse textured yarns, so-called BCF (bulked continuous filament) yarns, texturing can be carried out directly after filament extrusion, cooling and elongation. Typical BCF production rates are from 2500 to 5000 m/min. Simultaneous and sequential stretch texturing is known during false twist texturing. A characteristic feature of the two methods is that a heating zone and then a mechanical friction spindle for twist production are arranged in the direction of travel of the thread. During sequential stretch texturing (FIG. 1*a*) the yarn is stretched in a first stage and false twist texturing only carried out in a separate second stage (with respect to the yarn tension). As the twist acts in the direction of travel of the thread backwards to the next feed unit there before, a cooling zone can be arranged directly after the heating zone but in front of the twister. With simultaneous stretch texturing, stretching and texturing take place within the same stage, as shown in FIG. 1*b*. The highest possible yarn velocities can be achieved at present with the mechanical friction spindle. However, there is a natural limit to performance dictated mainly by the looping, the maximum permitted tensile stress on the yarn and the frictional resistance relative to the twist discs. If the performance of the twist discs which is to be transmitted exceeds a permitted level, surging occurs. A proportion of the already produced false twist with the travelling thread skips over the twist discs forwards in the direction of travel of the thread. This leads to an instantaneously reduced thread tension and simultaneously to a reduced twisting action. This effect is ultimately noticed as a defect on the finished textiles owing to periodically repeated differences, for example in colour.

The described methods are a combination of heating/cooling and a mechanically produced change in the molecular orientation. In contrast, air jet texturing is known, for example, from EP-PS 88 254. Air jet texturing utilizes the forces of air, in particular shock waves at the outlet from an air nozzle. The shock waves produce filament loops uninterruptedly on each individual filament. During air jet texturing, the yarn is guided into the air nozzle with a large overfeed. This overfeed is required during air jet texturing for the loops being formed in all directions, even toward the interior of the thread. The stability of the looped yarn is ensured by the loop action, but in particular by filament on filament friction. Production of the bulkiness in the false twist textured yarn, on the other hand, is based on the newly formed helical molecular orientation. The character of air jet textured yarn and of false twist textured yarn differs greatly. The two yarn qualities have their own particular fields of application. Apart from the qualitative differences (of air jet textured and false twist textured yarns), a main distinction between the two methods resides in the constructional dimensions of the texturing device. The mechanical friction spindle has dimensions which are a multiple of those of said air jet texturing nozzles. The mechanical friction spindle has extremely rapidly rotating parts in relation to the air jet texturing nozzle which does not require moving parts for its operation. The most obvious drawback of the mechanical friction spindle resides in the width dimension. If a parallel bundle of threads comprising many threads needs to be processed, the corresponding device is very wide. In addition to conventional long and deep stretch texturing machines, special machines are also constructed, for example for warp stretching, with which well over 1000 threads can be processed in parallel in a depth of 1 to 2 meters, but without texturing spindles. The same applies to warping devices. Warp stretching devices with a tangle arrangement show that air treatment can be carried out in a minimum of space. The desired aim is therefore to develop a compressed air element of suitably small shape, in particular with the possibility for optimized simultaneous processing.

US-PS 3 279 164 shows that attempts were made 40 years ago to utilize the capability of an air nozzle rather than the mechanical twister with an air nozzle to produce the known Helanca yarn. Attempts were made to work on the yarn with compressed air having at least half the speed of sound and at more than 200,000 rpm. The allegation that speeds of up to 1 million rpm have been attained is of interest. A large number of different constructional forms and air pressures from 1 to about 12 bar have been investigated from small cross section ducts to conventional nozzle passage cross sections. According to the technical teaching of the document, the sequential method was desired with a stretching procedure preceding the texturing zone. FIG. 48 which shows the critical operating conditions of the process is of particular interest. The overfeed was 15%. Pronounced variations in tension due to a twist doubling phenomenon occurred at a pressure exceeding 12 bar. Values between 8 and 12 bar were found to be the optimum pressure. The processing speed was usually 100 to 300 m/min. The speed of passage of the yarn which is extremely low by today's standards was probably the main reason why this air false twisting method could not succeed in practice. An enormous increase in the performance of the mechanical twister did in fact occur at the same moment and led to a four-fold to five-fold increase in the processing speed, that is to over a thousand m/min within 30 years. The opinion has been upheld until now in the specialist sphere that the air treatment of filament yarns is not economically viable, in particular with respect to false twist texturing, as confirmed by the most recent specialist literature, for example Dr. Demir, Istanbul, (Chemical Fibers International, 46/996 Dr. Demir, pages 361–363).

STATEMENT OF THE INVENTION

The inventor has set himself the object of seeking ways and means of developing suitable methods of treating the yarn with air technology without mechanically moving parts and preferably also achieving a "false twist texture". The aim was, in particular, simultaneous stretching and texturing, whether on the individual thread or on a bundle of threads. A part of the object was also to replace a mechanical twister with an air treatment nozzle for some applications.

The method according to the invention is characterized in that high pressure air higher than 14 bar is used and the filament yarn is stretch textured.

According to a particularly advantageous embodiment of the method, as for the stretch texturing of filament yarn with at least one heating zone and a cooling zone and a twister the partially stretched yarn, for example POY yarn, is simultaneously stretched and textured or stretch textured as starting material, the twist being produced on the yarn by an air treatment nozzle having a feed pressure in the range of 14 to 80 bar. The nozzle according to the, invention for the air treatment of filament yarns with a continuous air duct with tangential supply of compressed air into the yarn duct for producing a dominant twisting flow in the yarn duct, the yarn duct being miniaturized in design is characterized in that the nozzle is designed as a miniature nozzle for a high pressure range of more than 14 bar, in particular 20 to 50 bar.

A particularly preferred embodiment relates to a device, in particular a stretch texturing device, for the air treatment of filament yarns with at least one air treatment nozzle in miniaturized form, one air pressure device for a range of 20 to 50 bar and adjusting means for a selectable working pressure.

The inventor has also discovered that an upper meaningful limit for the air pressure actually existed with the former practice involving the air treatment of yarn by means of air treatment nozzles. In the first instance, a natural upper pressure limit of about 12 bar is noticed with pressure generators or compressors if compression is carried out in one stage. Secondly, all former known tests, including US-PS 3 279 164, showed that an increase beyond a pressure value over the range of 8 to 12 bar did not improve but rather impaired the result, depending on the concrete application. Therefore, it was not worth increasing the pressure over two or more stages, for example beyond 12 to 14 bar. To this was added the logic that, in each case, the increase in the air pressure cannot be used to increase the air speed despite the much higher production costs. The inventor accordingly adopted the reverse procedure. He recognized early that, in many applications, it was not the air speed alone or the increase in the air speed which must be decisive but rather a combination between this and the increase in the density of the air. The inventor was surprisingly able to discover, from large numbers of tests (contrary to the former notion) beginning from 100 bar with a steady reduction to the known values, noteworthy working windows which offered ideal conditions, in particular for the false twist texturing of yarns. The determined working windows are relatively narrow, in particular at low yarn velocities, and differ with respect to different yarn qualities. In the range of fine yarns, the window was frequently between 20 and 35 bar. This pressure can easily be produced with a two- or three-stage compressor. A further surprise resided in the fact that the good results were attained almost more easily at yarn velocities above 500 m/min and up to 800 m/min. This is therefore a velocity range which allows direct "inline use", for example with known warp stretching devices. A further important point resided in the discovery that the air forces must be controllable to a much higher extent than in the state of the art. The inventor sought possible ways of achieving very high air twist intensities down to the lowest yarn ducts. A correspondingly high mass flow of air was produced with high speeds of rotation of the yarn in order to achieve this. It was noted that the twist is more intensive if the quantity of air is conveyed tangentially into the yarn duct via many small transverse ducts. However, to obtain a high mass throughput of air with small cross section transverse ducts, the pressures were tested to values within the specified range of 20 to 100 bar at the nozzle inlet. Tests have confirmed the correctness of the assumptions. High pressure which is produced in two or more stages, in particular above 20 bar, can be used economically with a miniaturized nozzle. In particular with a special geometry, as will be explained hereinafter. The improvement resides in the fact that the compressed air consumption can be markedly reduced with the same output.

The invention allows quite a number of advantageous designs and applications. It is particularly preferable if all transverse ducts merge tangentially into the yarn duct in such a way that a dominant, cyclonic twisting flow is produced and the filament yarn is actually false twist textured. The advantages can be implemented immediately, the air nozzle operating as an equal twister like a good mechanical twister. A working window in the range of 14 to 50 bar working pressure is particularly preferably determined once or repeatedly for establishing the range limits according to which the optimum working feed pressure can be accordingly established within the window. Out of the specified pressure conditions, the flow is always critical/over-critical in the narrowest cross section. The air speed is the same in the sonic /ultrasonic range. The air speed can be increased only to a limited extent with a given nozzle geometry at higher pressure. Furthermore, all experiments have confirmed the inventor's assumption that the transferable force increases directly in proportion with the air density at least in a restricted range. The pressure range beneath the pressure window produces unsatisfactory texturing and, with a more pronounced reduction in pressure due to a steep increase in the thread tension, can very soon lead to the collapse of the texture. With low yarn velocities and high air feed pressure, the air forces are so great that the thread can be sheared off directly in the nozzle. The range over the pressure window results in surging, as already known with mechanical spindles. The best results could formerly be achieved if POY yarn was stretched textured simultaneously as starting material, with at least one heating zone, one cooling zone and subsequent air treatment nozzle in the direction of travel of the yarn, the yarn being false twist textured at a yarn feed rate of 400 to over 800 m/min via the air jet treatment nozzle. During the first attempts, without knowledge of the optimum working window, it was possible to achieve useful results only with the FOY quality under conditions similar to those described in US-PS 3 279 164. If the statements are correct, the tests confirm US-PS 3 279 164 which was disclosed to the inventor at a later stage. As the FOY yarn quality has rigid behaviour, i.e. can only be extended to a minimum, it was absolutely essential to use an overfeed so the shortening is compensated during twisting. The formation of a secondary twist is not unproblematic during this process.

According to the invention, an optimum working window is preferably determined first for each yarn quality. Optimum yarn tensions with respect to the yarn titre lie between 0.3 and 0.6 (cN/dtex) with a feed pressure between 20 and 40 bar. For this purpose, it is proposed that the yarn velocity, the working pressure and the yarn tension be selected as control variables with respect to yarn quality and appropriately optimized values be adjusted. The new invention also allows the false twist stretch texturing of yarn whether as an individual thread or as a bundle of threads. The yarn can be stretch textured in one stage in line, for example as a thread bundle immediately before being winded on a warp beam. The air treatment nozzle preferably has a higher number, for example 4 to 10 or more, preferably 4 to 8 transverse ducts. These are arranged either in a radial plane, in a plane parallel to the axis of the yarn duct or in a combination of the two. The transverse ducts open tangentially in the vicinity of the yarn duct wall so an intensive, maximum possible twisting flow is produced. A plurality of nozzles is advantageously arranged close together, i.e. nozzle to nozzle on a pressure distributing element for the parallel air treatment of a bundle of threads. Two or more nozzles can be combined in a nozzle block. It is also possible to form the nozzle element in one part and with a cylindrical surface shape, with sealing rings arranged in the two end regions of the surface shape, the compressed air supply being arranged between the two sealing rings. All previous tests yielded the best results when the yarn duct was designed symmetrically and in the form of a circular cylinder with a high surface quality in the central portion and when the apertures of the transverse bores were arranged in the central portion and the geometric position of all transverse bores was arranged identically with respect to tangential introduction into the yarn duct. The tangential ducts can lie in a common radial plane, in a slightly conical form or preferably in several mutually offset radial planes. According to a further embodiment, the nozzle element is designed in two parts and the tangential ducts arranged in a radial parting plane between the two parts. The yarn duct is preferably widened identically conically in the region of the yarn inlet and yarn outlet so the air treatment nozzle can be used for false twist texturing.

The invention also relates to a device for the air treatment of filament yarns and is characterized in that it comprises at least one or more air treatment nozzles in miniaturized form, an air pressure device for 14 to 80 bar, preferably 20 to 50 bar, and a controller, in particular for the yarn velocity, the yarn tensile force and a selectable working pressure with respect to the yarn quality to be processed. The device is preferably designed as a warp stretching device with a plurality of partially stretched, preferably POY yarns which are processed in parallel, or a corresponding bundle of threads, with at least one heater, one cooler and a nozzle block with a plurality of air treatment nozzles corresponding to the number of threads and a warp beam as well as a feed unit before the heater and after the nozzle block.

BRIEF DESCRIPTION OF THE INVENTION

The invention will now be described in more detail with reference to individual embodiments.

FIGS. 1*a*, 1*b* and 1*c* show state of the art false twist texturing.

FIG. 2 shows schematically a false twisting process according to the invention for individual threads.

FIG. 3*a* shows a working window according to the invention for the use of an air treatment nozzle.

FIG. 3*b* shows various thread tensile force charts.

FIGS. 5 and 6 show two designs of air treatment nozzles according to the invention.

Figure 8:
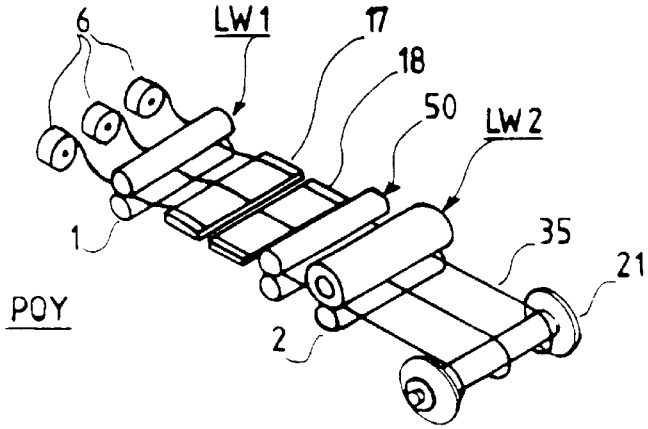
FIG. 8 shows a false twist stretch texturing bundle device according to the invention.
Figures 9A, 9B, 9C:
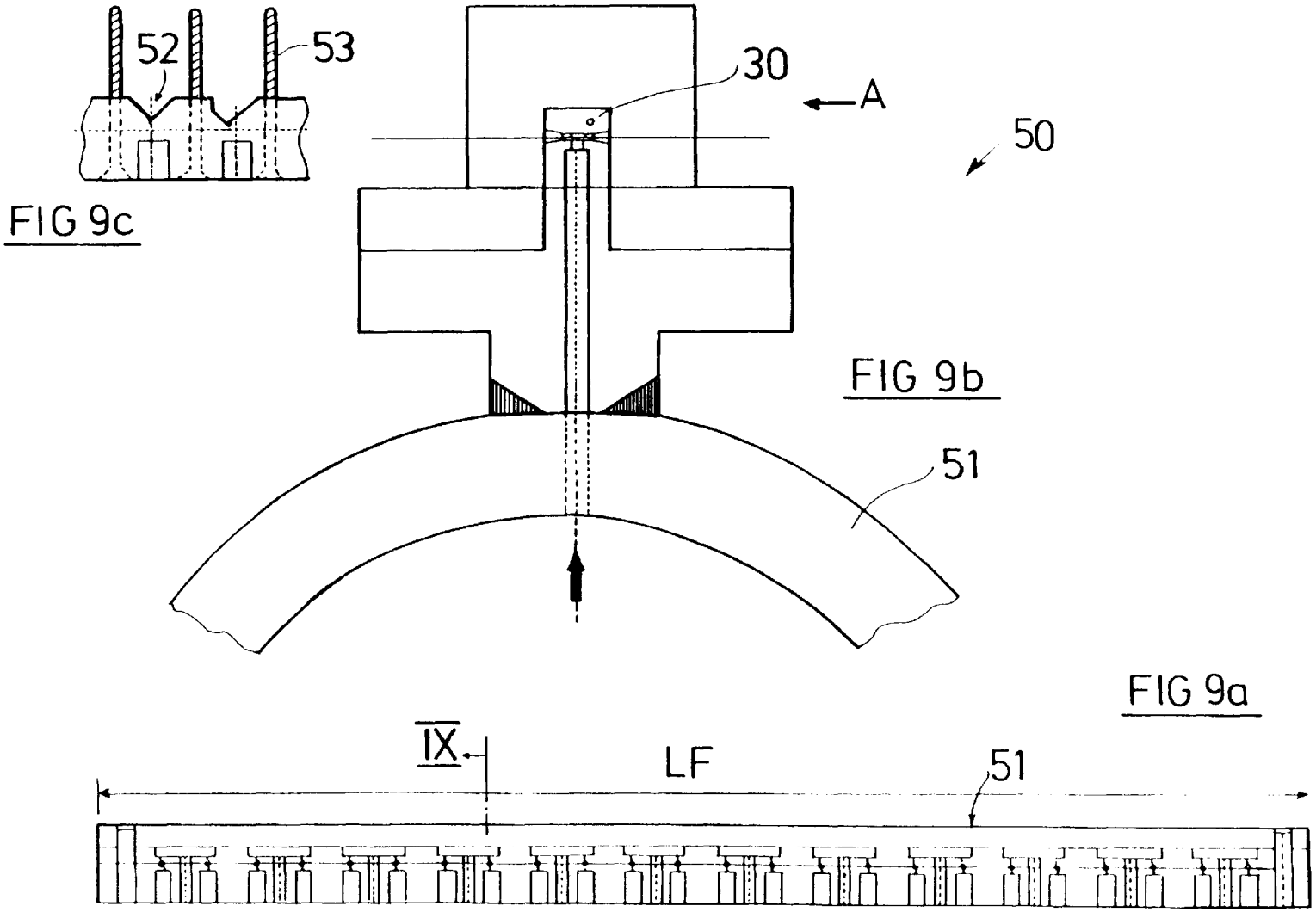

FIGS. 9*a*, 9*b* and 9*c* show a compressed air distributing pipe for FIG. 8.

Figure 10B:
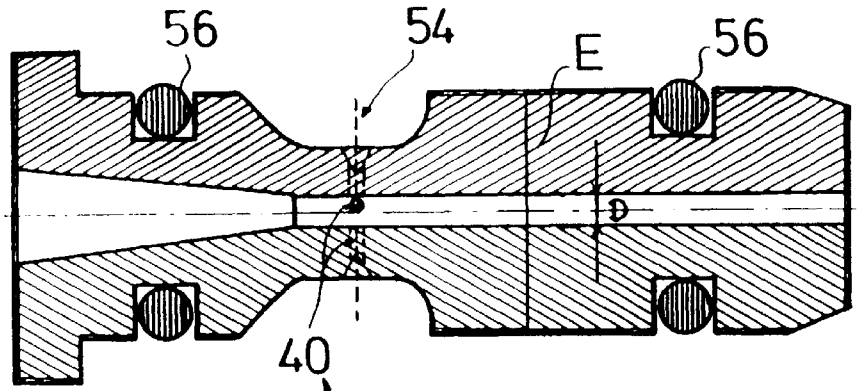
Figure 10A:
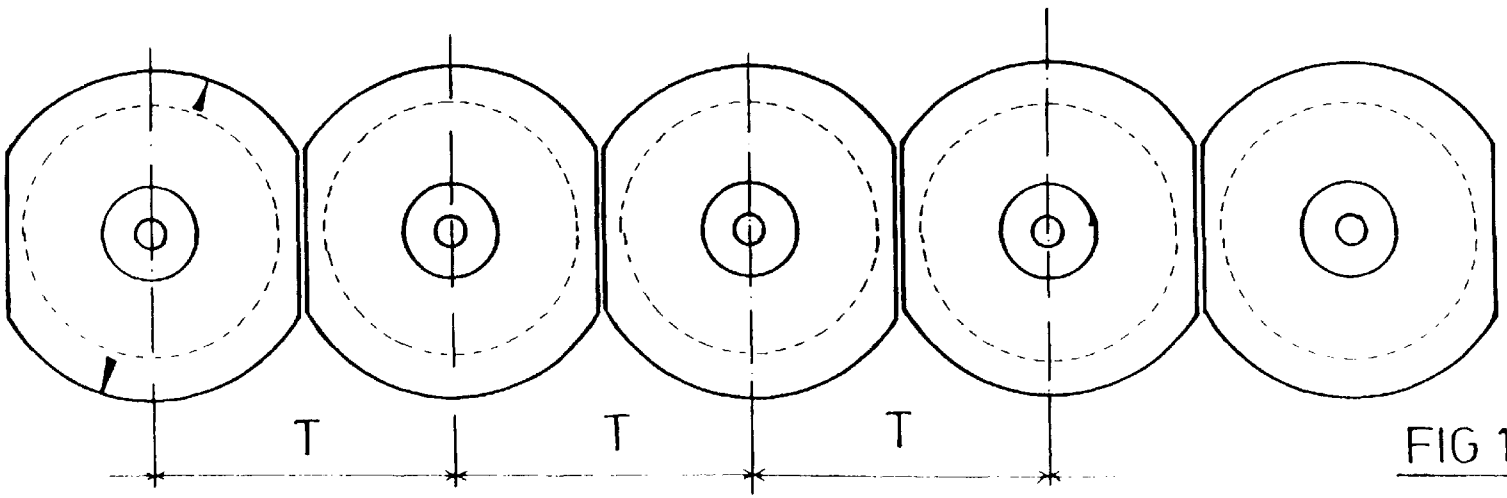

FIG. 10*a* shows a series of air treatment nozzles for a thread bundle with an individual nozzle (FIG. 10*b*).

METHOD AND IMPLEMENTATION OF THE INVENTION

Reference will be made hereinafter to FIGS. 1*a*, 1*b* and 1*c* which show the current practice and the state of the art. The two basic process steps are emphasized in the left-hand half of FIG. 1*a*. These are torsion production (Tors) and heat setting. Smooth yarn 4 is supplied to the process via a feed unit 1 (LW1) and is taken off as crimp quality yarn 5 after the feed unit 2 (LW2). The smooth yarn 4 is taken from a supply bobbin 6 according to FIGS. 1*b* and 1*c* and rewound, for example onto a winding bobbin 7. A mechanical twister, for example a friction spindle 8, is used as twister. The heat setting means 3 (therm. Fix) consists essentially of a heater 9 (H) and a cooler 10 (K). The twister 8 acts throughout heat setting stage. The effect is shown symbolically as twisted yarn 11. However, as this is a false twist, it is removed again after the twister 8. The change in molecular orientation produced by the treatment is shown on the right of FIG. 1, on the one hand as an external geometric configuration of the yarn thread and on the other hand as the internal orientation of the molecules. Reference is made to the publication, Chemical Fibers International, 46/1996 Dr. Demir, pages 361 to 363. The result of known false twist texturing is a crimp yarn 5 created by a correspondingly remaining inner structural change. FIG. 1*b* shows sequential stretch texturing. Upstream of a texturing zone (TZ) 12, the yarn is stretched into a stretching zone 13 (ST.Z) separated by the feed unit 1. In contrast, FIG. 1*c* shows simultaneous stretching and texturing in a stretch and texturing zone 14 (St.Z/TZ). This procedure is described as simultaneous stretch texturing. The processing section is reduced during simultaneous stretch texturing so this procedure can be carried out much more economically. As mentioned at the outset, extremely high production rates can be achieved nowadays using friction twisters.

Figure 7:
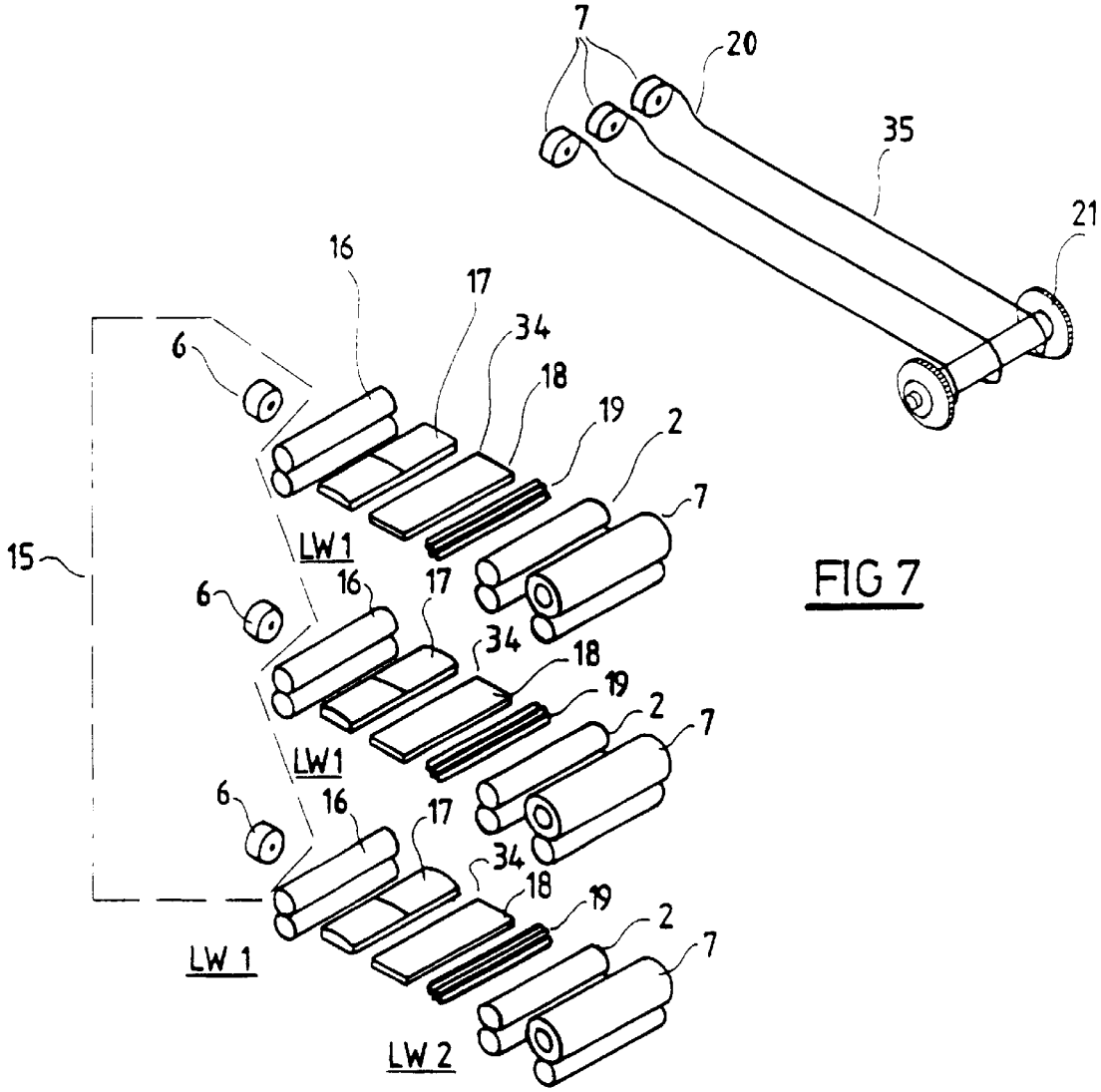
FIG. 7 shows schematically a state of the art FZ texturing machine.

For weaving purposes, the textured yarns have to be wound, for example, with 500 to 1000, sometimes with 1000 to 2000 parallel individual threads (FIG. 7). Winding cannot take place directly here owing to the very different pitches. In the state of the art, intermediate bobbins and supply bobbins 7 have to be produced first of all as first stage. With simultaneous stretch texturing, stretching and texturing can be carried out in one unit of the machine. However, winding onto a warp beam 16 also has to be carried out in a separate second stage, as shown in FIG. 7. As also shown in FIG. 7, a complete false twist stretch texturing unit consists of at least the following components: bobbin creel 15 for filament yarn bobbins; first thread conveyor LW1 for the thread bundle 20; heater plate 17 for thread bundle; cooling member (with or without forced cooling) 18; twist imparting devices 19; second thread conveyor LW2; winding beam for the thread bundle 20; monitoring devices at various points of the machine.

Figure 2:
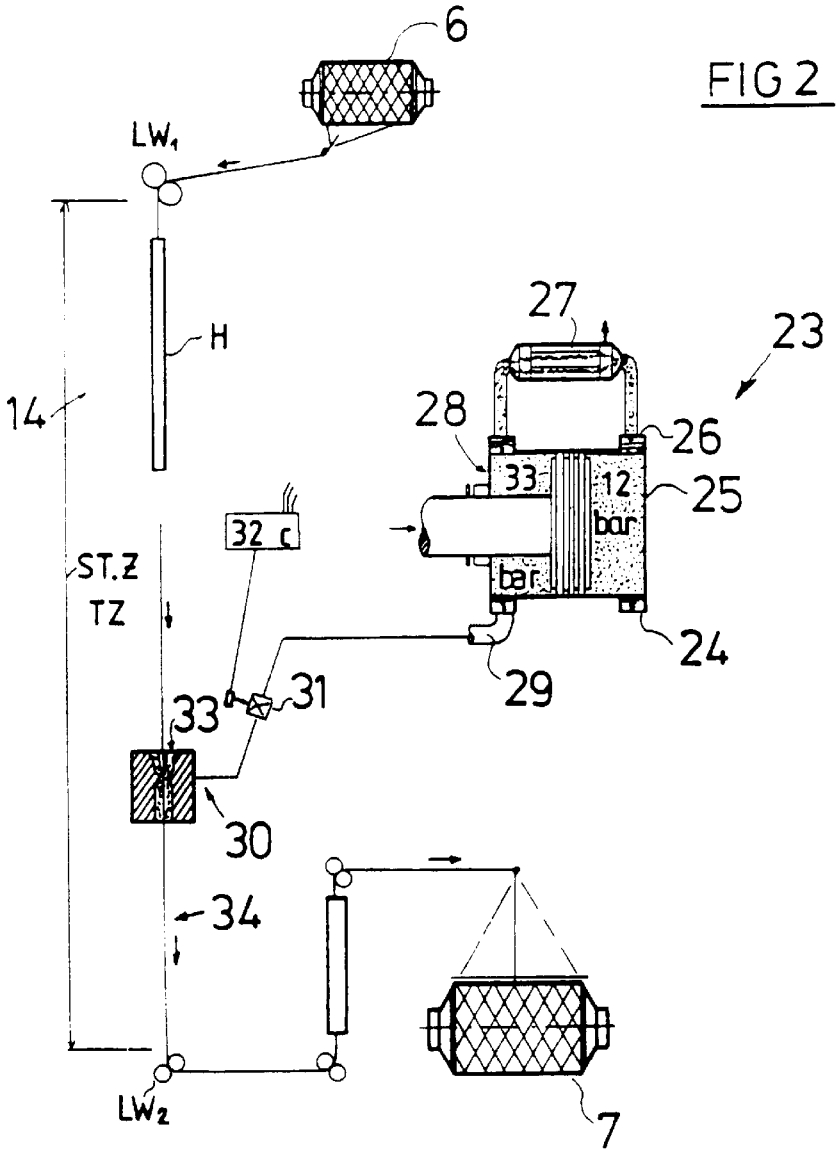

FIG. 2 shows a first example for use of the new invention. The first part of the device up to the heater corresponds to FIG. 1*c* in the same way as yarn conveyance after the twister. According to the new invention, the twister is a miniature nozzle 30.

Compressed air is supplied from a pressure generating unit 23 with high compression, in two-stage compression in the example, to the miniature nozzle 30. 12 bar is plotted merely as an example in the first stage and 33 bar in the second stage. Air I aspirated via an inlet 24, precompressed in the first compression stage 25, and guided via an outlet valve 26 and an air cooler 27 into the second compression stage 28. From the second stage, the air is supplied via an outlet valve and a corresponding compressed air guiding system 29 of the miniature nozzle 30 into the yarn duct 33. A pressure regulating valve is designated by 31, the pressure adjusting means by 32 and the effect yarn by 34.

Figure 3A:
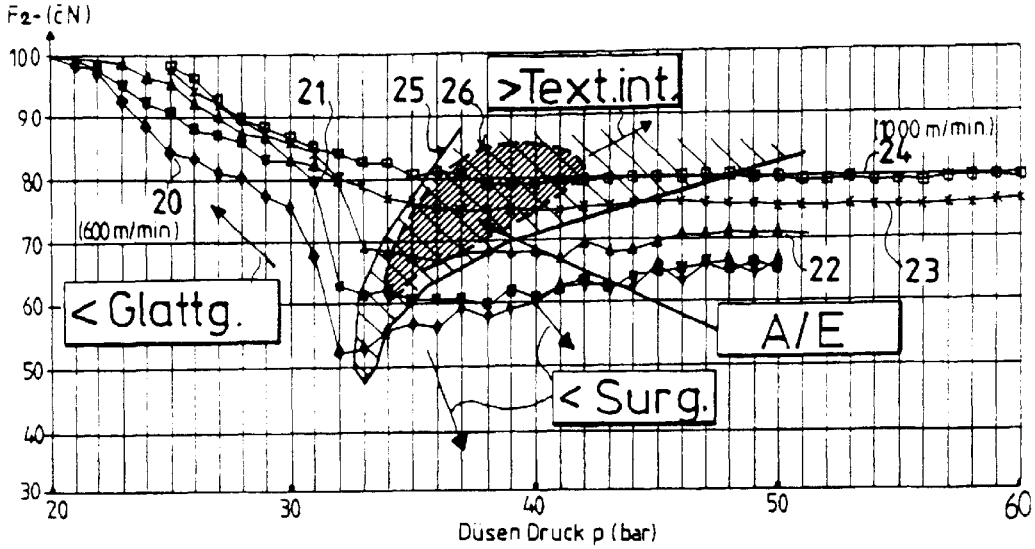

FIG. 3*a* is a graph showing the test results for a specific yarn quality (PES POY 167 f 30 VS-Visco Swiss). The concretely used nozzle has been designated by S3. Drawing was 1:1:766; the temperature of the heater 200° C. The cooling rail was 1.7 m long. A 100 cN Rothschild measuring head was used. The graph shows the thread tensile force F2 vertically after the nozzle over the pressure p in bar as horizontal axis. The curve bundle shows various yarn velocities V2. The respective tendency in the individual regions is marked by thick arrows: <Glattg. In the top left denotes increase in smooth yarn character; <Surg. Denotes increase in surging; >Text.int. denotes diminishing texturing intensity; A/E denotes working window and favourable range of adjustment. In the figure, an aspect according to an embodiment of the new invention resides in the compressed air/working window. Another aspect according to an embodiment of the present invention resides in the configuration of the air treatment nozzles. The main problem for discovering the solution resided in the fact that the success of the miniaturized nozzles was dependent on the discovery of the working windows and the working window dependent on the existence of the miniaturized nozzle. The pressure of the air supply (20 to 60 bar) is shown on the horizontal axis and the yarn tensile force in cN on the vertical axis. The five curves 20, 21, 22, 23, 24 were produced as texturing tests at 600 to 1000 m/min. A quite pronounced depression has been formed in the central field, at about 30 to 40 bar. When evaluating the graph, it is particularly important to observe the processing limits. On the left-hand side, these reside in the fact that texturing takes place only to a limited extent or not at all. Smooth yarn is increasingly produced as a result instead of the crimp structure, and texturing takes place to a lesser extent. An increase in texturing but also increasing surging are noted on the right-hand side. The working window A/E bounded by the thick solid line 25 is located there between. A desirable range of adjustment which is bounded by the broken line 26 can be seen within the working window A/E (with double diagonal hatching). The curves can be displaced very markedly, for example in the range of 20 to 30 bar or over 40 bar, depending on yarn type. What is actually surprising, as expressed clearly by the graph, is that the working window is "on its head". It has in fact surprisingly been found that a wider window exists and a good quality can be achieved more easily in the higher velocity range (top). During a further increase in the production rate, however, with a given nozzle shape, the quality is limited or the intensity of texturing decreases so markedly that the quality no longer suffices.

Figure 3B:
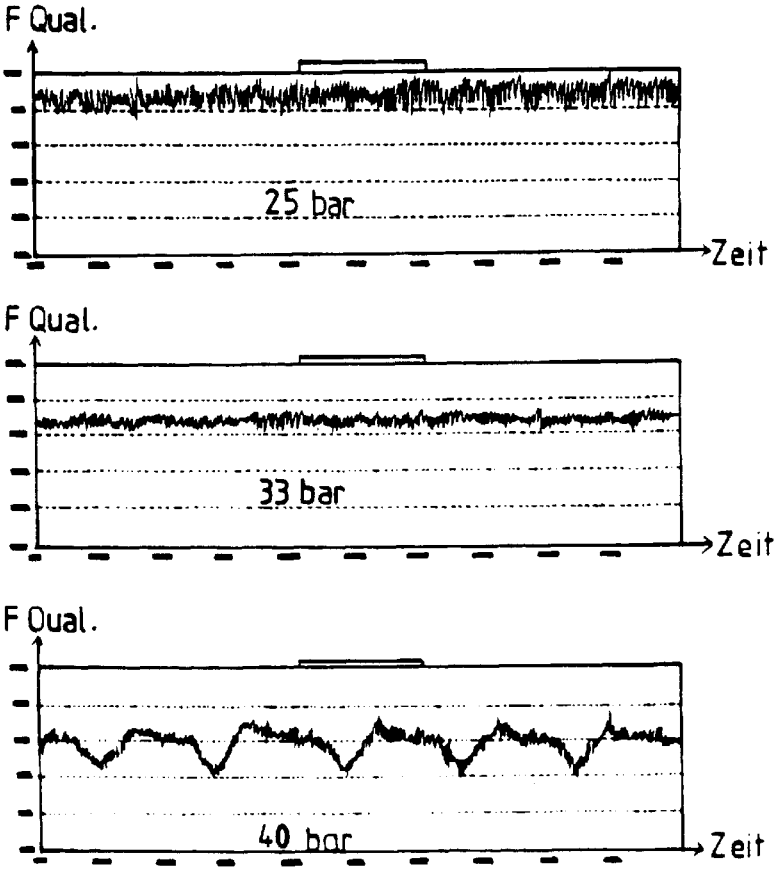

FIG. 3*b* shows an example with a different yarn quality PES POY 167 f30 RP Rhone Poulenc. FIG. 3*b* shows the qualitative trend of yarn treatment with three different working pressure adjustments. The variation in the yarn tensile force F is shown vertically and the time horizontally as quality criterion. Drawing was 1.766 and the yarn velocity 600 m/min. The length of the heating zone was 3 m and the temperature 200° C. The same nozzle was used as in FIG. 2. 33 bar feed pressure was located in the centre of the working window and produced a very good yarn quality or crimp structure and also very stable values. At 25 bar, a more pronounced variation occurred in the yarn tensile force, at which the quality of the textured yarn decreased. A yarn tensile force which varied in an undulating manner and which was quite typical for the surging occurred at 40 bar. The corresponding varying intensity of texturing makes the yarn quality unserviceable. The working pressure was adjusted at 33 bar in the example according to FIG. 3*b*.

Figure 4:
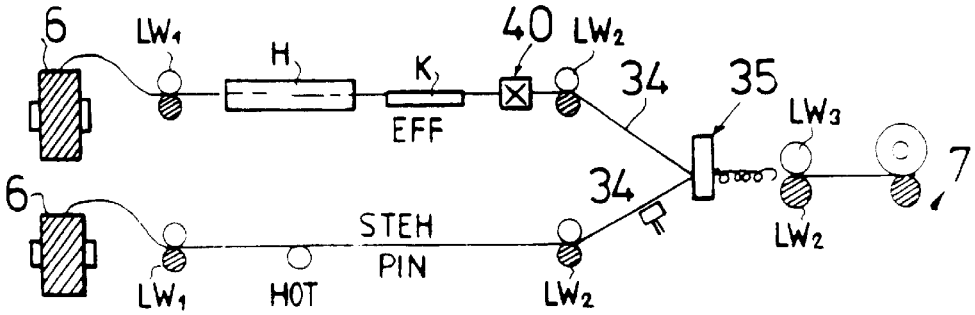
FIG. 4 shows schematically a false twisting process with coupled air texturing process.

FIG. 4 shows a combined application wherein the false twisting process and the air texturing process 36 are coupled. The FZ yarn structure is open immediately after false twisting. The filaments are not braided with one another.

This is a basic condition for the air texturing of an FZ yarn. The effect yarns/yarn 34 (EFF) as well as the standing yarn 35 (STEH) can be FZ or only one of the two yarn strands. The product is a thread with an increased texture and a characteristic feel.

Figure 5A:
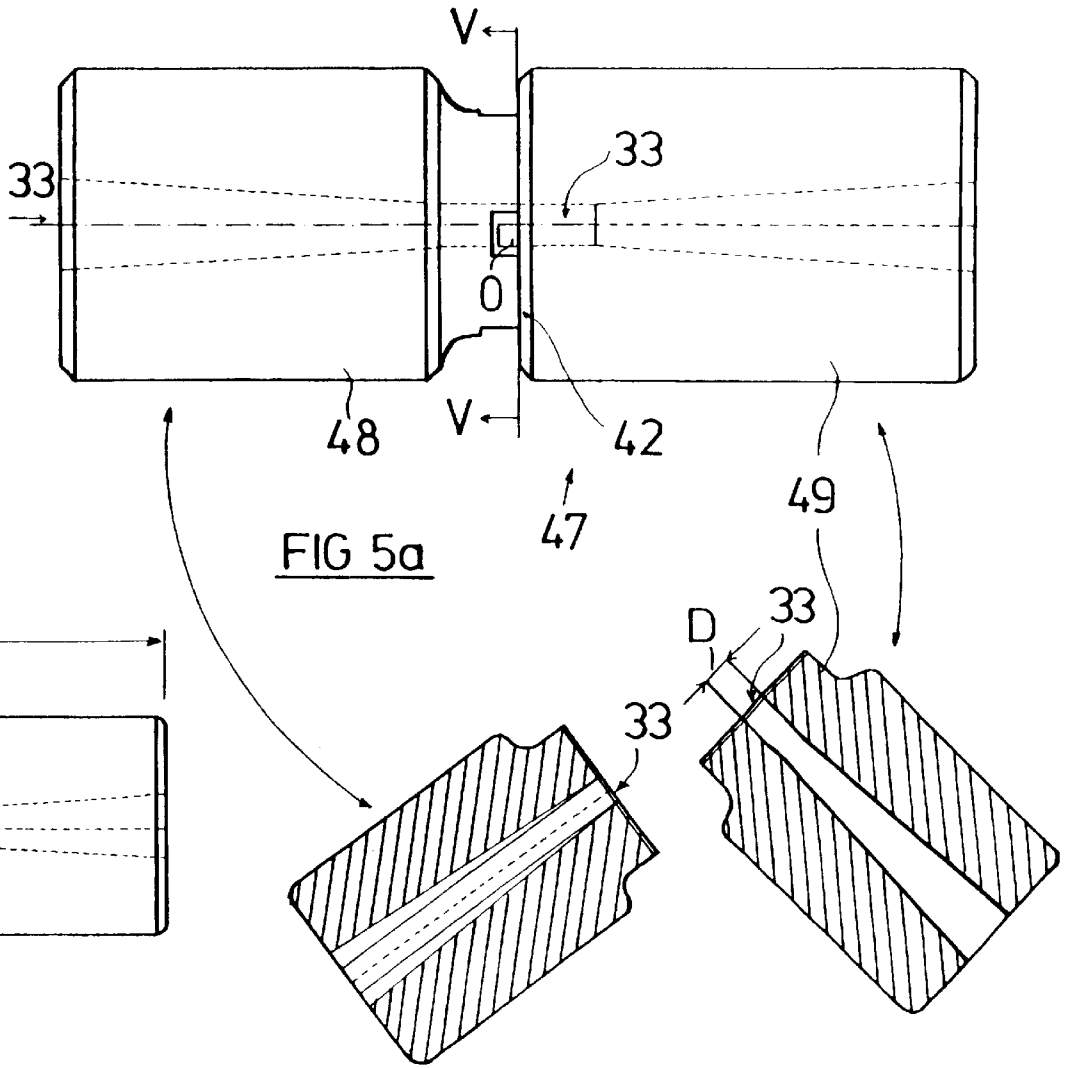
Figure 5B:
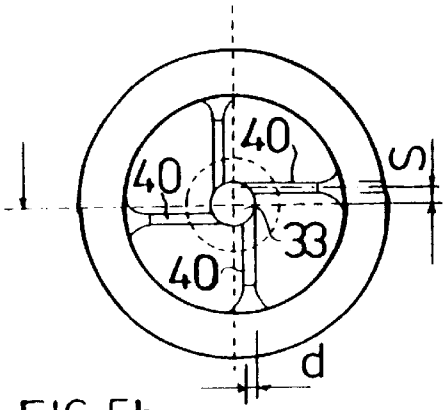
Figure 5C:
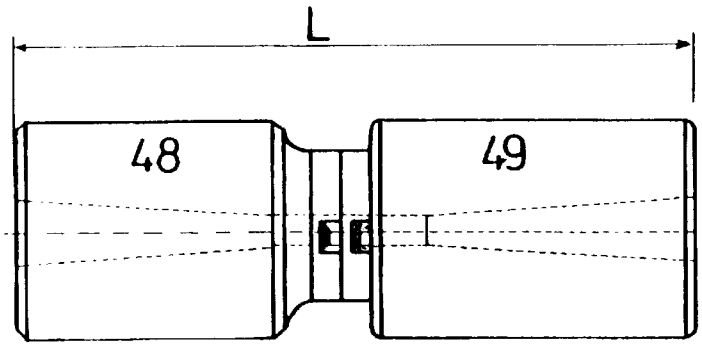

FIGS. 5 and 6 show highly magnified examples of air treatment nozzles. The yarn duct 33 has a diameter D preferably smaller than 1 mm for fine yarns with a typically low dtex and the transverse ducts d (30) for the air supply a range of 0.1 to 0.3 mm. The length L of the nozzle was between about 1 and 1.5 cm. These were actual miniature nozzles. FIGS. 5 to 6 are correspondingly great magnifications. The geometric position with respect to the tangential introduction is preferably identical in all transverse ducts 40. This also applies with the following constructional shape. The tangential orientation is selected such that the outermost line of the transverse ducts 40 ends tangentially to the external surface of the yarn duct. The dimension S is selected in proportion to the yarn duct diameter and transverse bore diameter. FIGS. 5*a* and 5*b* show a nozzle insert 47 which is made up in two parts from a nozzle block 48 and a counterpart 49. As shown in FIG. 5*a*, the transverse ducts 40 are arranged in the nozzle block. The abutting face of the two nozzle blocks 48, 49 is designated by 42.

FIGS. 6*a* to 6*d* show a particularly interesting nozzle construction. Instead of the conventional bores in the nozzle member, a variable number of thin plates 43 with a respective worked-in transverse duct 40 has been produced instead of the conventional bores in the nozzle member. A respective end piece 44 and an opposing piece 45 is arranged on either side of the plates 43. The desired number of, for example 8, plates 43, an end Diece 44 and an opposing piece 4S are pushed into a sleeve 46 and together form a nozzle 47. The effectiveness of this nozzle 47 was surprisingly good, each transverse bore 40 lying in a parallel transverse plane and being displaceable in the circumferential direction. The solution according to FIG. 6 has the advantage that any number of transverse ducts can be provided by selecting the number of plates. At least tests have confirmed that the effect is improved with an increasing number of transverse ducts. The transverse ducts were found to be the best form in various transverse planes.

FIG. 8 shows a very interesting application of the new invention for the treatment of a bundle of threads. POY quality yarn is taken from bobbins 6 and, after a feed unit 1, is guided into the one simultaneous stretch texturing of the bundle of threads with a heater 17, a cooler 18 and a nozzle distributing block 50 and subsequent feed unit 2. FIG. 8 indicates that a plurality of threads which extend in parallel and are wound directly onto a warp beam 16 after the feed unit 2 is being treated. Comparison of FIGS. 7 and 8 shows that the new invention allows stretch texturing and winding onto a warp beam in a single stage, 100 or more individual threads being processed in parallel as known. The former prejudice whereby simultaneous stretch texturing was not possible, at least not economically possible with air nozzles, could be overcome for the first time.

FIG. 9*a* shows schematically a nozzle block 50 with a pressure distributing pipe 51 on which air treatment nozzles according to the invention are fitted according to the number of individual threads to be processed. FIG. 9*b* is a section IX of FIG. 9*a* hand show a miniature nozzle 30 arranged on the pressure distributing member. FIG. 9*c* shows a view A of FIG. 9*b*. Two miniature nozzles with threading slot 52 and yarn guides 53 are shown. The length detail LF corresponds substantially to the entire width of the machine or the length of the warp beam 16.

FIG. 10*a* shows a detail of a series of miniature nozzles 30 as nozzle inserts which can be lined up close together with the minimum possible spacing and can be mounted on a pressure distributing pipe 51. The pitch T can be in the region of half a centimeter, that is very close to the spacing of the parallel threads of warp stretching devices. A nozzle core 55 is shown again in FIG. 10*b*. A region 54 for the compressed air supply with transverse ducts 40 can be seen. The nozzle core has an external cylindrical form designated by E and a respective sealing ring 56 on either side.

The new invention proposes that filament yarns, in particular partially stretched yarns known as POY yarns, be subjected to stretch texturing via an air treatment nozzle. The air treatment nozzles are designed in miniaturized form, have a continuous yarn duct in which there open a plurality of transverse bores for the supply of high pressure air in the range of over 14 bar, preferably between 20 and 50 bar within specific working windows. The new invention has made it possible for the first time to process POY yarn by simultaneous stretch texturing using an air twister. The invention allows an individual thread as well as a parallel thread bundle to be treated and permits, for the first time, the construction of a false twist stretch texturing bundle device with simultaneous air treatment of 500 to 1000 and more threads.

The following table shows the results of parallel tests with mechanical twisters and air twisters according to the invention which usually produce identical values.

| | | Var. 1 | Var. 2 | Var. 3 | Var. 4 |
|---|---|---|---|---|---|
| | | Nozzle (best var) HE 600 m/min | | Friction HE 600 m/min | |
| | | POY | | POY | |
| | | PA | PES | PA | PES |
| | | 78 | 78 | 78 | 78 |
| | | 34 | 34 | 34 | 34 |
| Titre | | 79 | 80 | 80 | 76 |
| Tensile strength at break | RF (cN/dtex) | 3.2 | 3.6 | 4.2 | 3.9 |
| Variation in tensile strength at break | V (%)-RF | 3.7 | 2.53 | 2.07 | 4.41 |
| Elongation at break | RD (%) | 20 | 16 | 30 | 16 |
| Variation in elongation at break | V (%)-RD | 9.32 | 5.93 | 4.04 | 9.38 |
| Curling | EK (%) | 47 | 39 | 49 | 43 |

-continued

| | | Var. 1 | Var. 2 | Var. 3 | Var. 4 |
|---|---|---|---|---|---|
| | | Nozzle (best var) HE 600 m/min | | Friction HE 600 m/min | |
| Crimp contraction | KK (%) | 27 | 22 | 26 | 26 |
| Crimp retention | KB (%) | 60 | 93 | 56 | 93 |
| Twist/m | T/m | 2640 | 3005 | 2855 | 3610 |
| Revolutions per min | rpm × 10'6 | 1.57 | 1.79 | 1.71 | 2.16 |
| Thread tensile force | F2 (cN) after nozzle | 28 | 36 | 20 | 30 |
| Variation F2 | V (%)-F2 | 0.2–0.3 | 0.27–0.4 | 0.19–0.26 | 0.19–0.29 |
| | Gam Note | i.O | i.O | i.O | i.O |
| | Zone | FD 2000 | | Giudici TG20 | |
| Before heater | v1 (m/min) | 468 | 347 | 478 | 329 |
| After spindle/nozzle | v2 (m/min) | 595 | 595 | 598 | 598 |
| Winding velocity | v-ww (m/min) | 575 | 575 | 571 | 568 |
| | Drawing 1:x.xx | 1.271 | 1.715 | 1.251 | 1.818 |
| Temperature 1st heater | T-HE (° C.) | 210 | 190 | 210 | 190 |
| Spindle components | Spi/Sch 9 mm | | | 1-5P-1 | 1-5P-1 |
| | D/Y | | | 1.8 | 1.8 |
| | HD nozzle pressure (bar) | 24 | 35 | | |

What is claimed is:

1. A device for treating filament yarns, comprising:

a nozzle defining a continuous yarn duct; and a tangential supply of compressed fluid in flow communication with the yarn duct such that the compressed fluid tangentially enters the yarn duct to produce a dominant twisting flow in the yarn duct, wherein the tangential supply has a pressure greater than approximately 14 bar.

2. The device of claim 1, further comprising at least three tangential ducts opening into the yarn duct such that a maximum twist flow is produced.

3. The device of claim 2, wherein the tangential ducts are arranged in one of a radial plane, a plane parallel to the yarn duct axis, and a combination of a radial plane and a plane parallel to the yarn duct axis.

4. The device of claim 1, further comprising at least a second nozzle, wherein the nozzles are configured for a parallel air treatment of a bundle of threads forming the filament yarn, the nozzles being provided in a nozzle block.

5. The device of claim 1, wherein the nozzle includes a cylindrical surface and sealing rings are disposed in two end regions of the cylindrical surface, the supply of compressed fluid being arranged between the sealing rings disposed in each end region.

6. The device of, claim 1, further comprising a plurality of tangential ducts having openings in flow communication with the yarn duct for supplying the compressed fluid to the yarn duct, wherein the yarn duct has a cylindrical configuration in a central portion and the openings of the plurality of tangential ducts are arranged in the central portion of the yarn duct.

7. The device of claim 1, further comprising at least four tangential ducts for supplying the compressed fluid to the yarn duct, the tangential ducts being arranged in one of a common radial plane, in mutually offset radial planes, and in slightly conical form.

8. The device of claim 1, wherein the nozzle includes two parts and a plurality of tangential ducts are arranged in a radial parting plane between the two parts, the tangential ducts being configured to supply the compressed fluid to the yarn duct.

9. The device of claim 1, wherein the yarn duct conically widens from a central portion of the duct to a yarn inlet region of the duct and from the central portion of the duct to a yarn outlet region of the duct.

10. The device of claim 1 wherein the compressed fluid supplied to the yarn duct has a pressure ranging from approximately 20 bar to approximately 50 bar.

11. The device of claim 1, wherein the compressed fluid supplied to the yarn duct includes air.

12. The device of claim 1, wherein the yarn duct has a diameter less than approximately 1 mm and a length ranging from approximately 1 cm to approximately 1.5 cm.

13. The device of claim 1, further comprising at least one supply duct for supplying the compressed fluid to the nozzle duct, the supply duct having a diameter ranging from approximately 0.1 mm to approximately 0.3 mm.

14. The device of claim 1, further comprising:

at least one heater;

at least one cooler; and a nozzle block for holding a plurality of air treatment nozzles, wherein the device is configured as a warp stretching device for processing in parallel one of a plurality of partially stretched POY yarn bundles and a plurality of partially stretched POY yarn threads.

15. A device for the air treatment of individual threads of filament yarn, if the device comprising:

at least one air treatment nozzle configured to provide air treatment to at least one thread;

a compressed air supply configured to supply to the nozzle air having a pressure ranging from approximately 16 bar to approximately 80 bar; and an adjusting means for selecting a working pressure of the compressed air supplied to the nozzle.

* * * * *

UNITED STATES PATENT AND TRADEMARK OFFICE

CERTIFICATE OF CORRECTION

PATENT NO. : 6,651,420 B2
DATED : November 25, 2003
INVENTOR(S) : Simmen

It is certified that error appears in the above-identified patent and that said Letters Patent is hereby corrected as shown below:

Title page,
Item [*] Notice, delete the phrase "by 121 days" and insert -- by 0 days --

Signed and Sealed this

Twenty-eighth Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,651,420 B2
DATED : November 25, 2003
INVENTOR(S) : Christian Simmen It is certified that error appears in the above-identified patent and that said Letters Patent is hereby corrected as shown below:

Column 11,
Line 51, "of, claim 1," should read -- of claim 1, --.

Column 12,
Line 32, "claim 1 wherein" should read -- claim 1, wherein --.
Line 55, "yarn, if the" should read -- yarn, the --.

Signed and Sealed this

Eleventh Day of January, 2005

JON W. DUDAS
*Director of the United States Patent and Trademark Office*